US009761397B1

(12) United States Patent
Weber et al.

(10) Patent No.: US 9,761,397 B1
(45) Date of Patent: Sep. 12, 2017

(54) ELECTRICAL RELAY DEVICE

(71) Applicant: TYCO ELECTRONICS CORPORATION, Berwyn, PA (US)

(72) Inventors: Ronald Martin Weber, Annville, PA (US); William E. Veith, Hershey, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/190,270

(22) Filed: Jun. 23, 2016

(51) Int. Cl.

| | |
|---|---|
| ***H01H 9/02*** | (2006.01) |
| ***H01H 50/02*** | (2006.01) |
| ***H01H 50/54*** | (2006.01) |
| ***H01H 50/64*** | (2006.01) |
| ***H01H 50/36*** | (2006.01) |

(52) U.S. Cl.
CPC ..... *H01H 50/02* (2013.01); *H01H 50/36* (2013.01); *H01H 50/54* (2013.01); *H01H 50/64* (2013.01)

(58) Field of Classification Search
CPC ..... H01H 50/32; H01H 50/443; H01H 49/00
USPC ..... 335/202
See application file for complete search history.

(56) References Cited

U.S. PATENT DOCUMENTS 3,017,474 A * 1/1962 Huetten ..... H01H 50/20 335/179
4,177,439 A * 12/1979 Smith ..... H01H 51/281 29/602.1
4,292,614 A * 9/1981 Ono ..... H01H 50/023 335/132
4,419,640 A * 12/1983 Agatahama ..... H01H 11/0056 335/106
4,574,260 A * 3/1986 Franks ..... H01H 83/04 335/18
4,626,812 A * 12/1986 Nakanishi ..... H01H 51/2227 174/359
4,831,348 A * 5/1989 Agatahama ..... H01H 51/2227 335/128
4,906,337 A * 3/1990 Palmer ..... C02F 1/16 126/362.1
4,975,623 A * 12/1990 Iketani ..... H01H 51/34 181/192
5,770,902 A * 6/1998 Batten ..... H02K 5/225 310/68 D
5,880,653 A * 3/1999 Yamada ..... H01H 49/00 335/128
5,901,025 A * 5/1999 Takahashi ..... H01H 89/06 361/115
6,116,558 A * 9/2000 Yano ..... H01R 13/443 248/27.3

(Continued)

*Primary Examiner* — Shawki S Ismail
*Assistant Examiner* — Lisa Homza

(57) ABSTRACT

An electrical relay device includes a housing extending between a closed end and an open end defining a chamber. The closed end of the housing faces and is mounted to a circuit board. A driver is received in the chamber and is electrically connected to a relay power source. The driver includes a coil and coil terminals terminated to the circuit board. A switch member is positioned in the chamber and moves between a first position and a second position. The switch member includes a movable relay contact. A cover is coupled to the housing at the open end. The cover holds the coil with the movable relay contact positioned between the coil and the closed end of the housing facing the circuit board.

19 Claims, 3 Drawing Sheets

(56) References Cited

U.S. PATENT DOCUMENTS 6,266,867 B1 * 7/2001 Kern ..... H01H 49/00 29/602.1
6,337,614 B1 * 1/2002 Tsutsui ..... H01H 50/02 335/160
6,411,189 B1 * 6/2002 Noda ..... H01F 5/02 336/192
6,771,154 B1 * 8/2004 Funayama ..... H01H 9/40 335/136
9,036,320 B1 * 5/2015 Elberbaum ..... H01H 47/22 361/160
2002/0036556 A1 * 3/2002 Matsuda ..... H01H 50/12 335/78
2003/0067372 A1 * 4/2003 Funayama ..... H01H 50/026 335/128
2005/0040920 A1 * 2/2005 Takano ..... H01H 50/043 335/128
2005/0070162 A1 * 3/2005 Espenshade ..... H01R 24/64 439/620.11
2006/0007643 A1 * 1/2006 Hirata ..... H05K 1/0203 361/616
2006/0089050 A1 * 4/2006 Smith ..... H01H 9/10 439/620.29
2007/0097602 A1 * 5/2007 Zeitlberger ..... H01H 50/021 361/600
2009/0072935 A1 * 3/2009 Yuba ..... H01H 9/443 335/201
2010/0109821 A1 * 5/2010 Takano ..... H01H 50/047 335/202
2011/0221549 A1 * 9/2011 Tsutsui ..... H01H 1/60 335/186
2013/0076465 A1 * 3/2013 Hernandez-Oliver . B60Q 1/441 335/205
2013/0285774 A1 * 10/2013 Hasegawa ..... H01H 3/28 335/189
2013/0293325 A1 * 11/2013 Becker ..... H01P 1/15 335/207
2013/0294014 A1 * 11/2013 Irons ..... H02B 7/00 361/626
2014/0077907 A1 * 3/2014 Lai ..... H01H 1/0015 335/185
2014/0126158 A1 * 5/2014 Baran ..... H01H 71/08 361/729
2015/0097446 A1 * 4/2015 Elberbaum ..... H01H 9/00 307/113
2015/0135016 A1 * 5/2015 Glaser ..... G06F 11/079 714/37
2015/0137918 A1 * 5/2015 Weber ..... H01H 50/048 335/202
2015/0187528 A1 * 7/2015 Elberbaum ..... H01H 51/27 361/195
2015/0318133 A1 * 11/2015 Lauraire ..... H01H 50/002 335/185
2016/0049273 A1 * 2/2016 Jang, II ..... H01H 47/10 335/192
2016/0189898 A1 * 6/2016 Blackwood ..... H01H 47/002 235/375
2016/0189900 A1 * 6/2016 Beauregard ..... H01H 50/32 335/170

* cited by examiner

ELECTRICAL RELAY DEVICE

BACKGROUND OF THE INVENTION

The subject matter herein relates generally to electrical relay devices.

Electrical relay devices are generally electrically operated switches used to control the presence or absence of current flowing through a circuit between electrical components, such as from a power source to one or more electrical components that receive power from the power source. Some electrical relays use an electromagnet to mechanically operate a switch. The electromagnet is configured to physically translate a movable electrical contact relative to one or more stationary relay contacts. The movable electrical contact may form or close a circuit (allowing current to flow through the circuit) when the movable relay contact engages one or more of the stationary relay contacts. Moving the movable electrical contact away from the stationary relay contact(s) breaks or opens the circuit (ceasing the flow of current through the circuit) and/or closes another circuit.

Known electrical relay devices have some disadvantages. For example, some electrical relay devices have a component stack-up height that is too large for certain applications. For example, for printed circuit board mounted applications, it may be desirable to have low profile components to provide a compact circuit board assembly. The features and components of known electrical relay devices, such as those used to retain and position the movable and fixed relay contacts, the coil and the height added by the armature attached to the moving relay contact, have a resulting component stack-up that is quite high relative to a width of the relay.

A need remains for an electrical relay device having a low profile.

BRIEF DESCRIPTION OF THE INVENTION

In an embodiment, an electrical relay device is provided including a housing extending between a closed end and an open end. The housing defines a chamber. The closed end of the housing faces and is configured to be mounted to a circuit board. A driver is received in the chamber and is electrically connected to a relay power source. The driver includes a coil and coil terminals configured to be terminated to the circuit board. A switch member is positioned in the chamber of the housing and is configured to move between a first position and a second position based on a presence or absence of a magnetic field that is induced by current through the coil. The switch member includes a movable relay contact spaced apart from at least one stationary relay contact when the switch member is in the first position and engaging the at least one stationary relay contact to provide a closed circuit path when the switch member is in the second position. A cover is coupled to the housing at the open end. The cover holds the coil with the movable relay contact positioned between the coil and the closed end of the housing facing the circuit board.

In another embodiment, an electrical relay device is provided including a housing extending between a closed end and an open end. The housing defines a chamber. The closed end of the housing faces and is configured to be mounted to a circuit board. Stationary relay contacts are mounted to the closed end of the housing. Each stationary relay contact has a mating interface exposed in the chamber and a circuit board interface exposed exterior of the housing for termination to the circuit board. A driver is received in the chamber and is electrically connected to a relay power source. The driver has a coil and coil terminals configured to be terminated to the circuit board. A switch member is positioned in the chamber of the housing and is configured to move between a first position and a second position based on a presence or absence of a magnetic field that is induced by current through the coil. The switch member includes a movable relay contact that is spaced apart from at least one of the stationary relay contacts when the switch member is in the first position and engages at least one of the stationary relay contacts in the second position to provide a closed circuit path.

In a further embodiment, an electrical relay device is provided including a circuit board having a mounting surface and a power circuit at the mounting surface electrically connected to a relay power source. Stationary relay contacts are mounted to the power circuit on the mounting surface of the circuit board. Each stationary relay contact has a mating interface. A housing is mounted to the circuit board at the mounting surface. The housing extends between a closed end and an open end and defines a chamber. The housing has an end wall defining the closed end having at least one opening therethrough. The closed end of the housing is mounted to the mounting surface of the circuit board such that the stationary relay contacts are exposed to the chamber through the at least one opening in the end wall. A driver is received in the chamber and is electrically connected to the relay power source. The driver has a coil and coil terminals terminated to the circuit board. A switch member is positioned in the chamber of the housing and is configured to move between a first position and a second position based on a presence or absence of a magnetic field that is induced by current through the coil. The switch member includes a movable relay contact that is spaced apart from at least one of the stationary relay contacts when the switch member is in the first position and engages at least one of the stationary relay contacts in the second position to provide a closed circuit path.

DETAILED DESCRIPTION OF THE INVENTION

Figure 1:
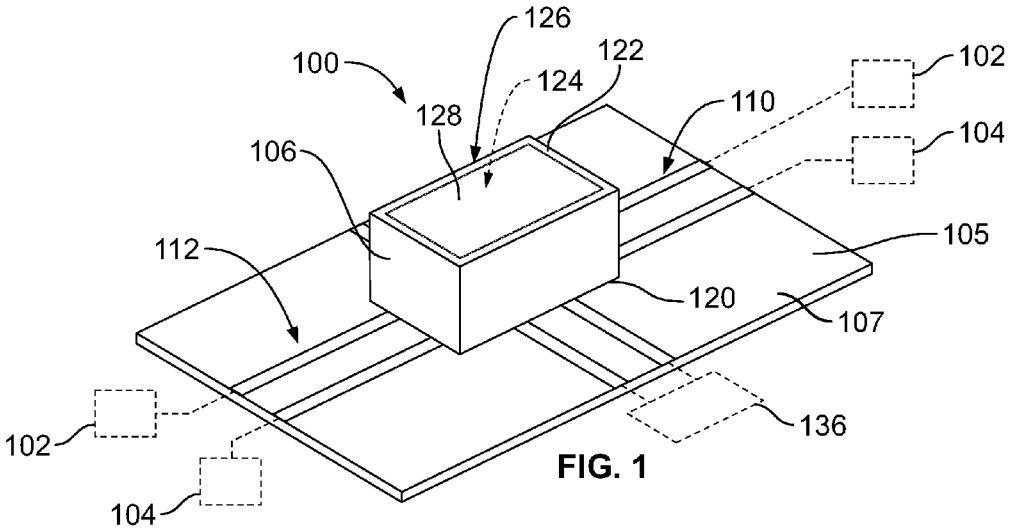
FIG. 1 is a perspective view of an electrical relay device formed in accordance with an embodiment.

FIG. 1 is a perspective view of an electrical relay device 100 formed in accordance with an embodiment. The electrical relay device 100 is an electrically operated switch. For example, the electrical relay device 100 is used to control the presence or absence of current flowing through one or more circuits. The electrical relay device 100 may close (or form) the circuit to allow current to flow through the circuit, and the electrical relay device 100 may open (or break) the circuit to stop the flow of current through the circuit, which may close (or form) another circuit. The electrical relay device 100 is operated to selectively close and open the circuit(s). Optionally, the circuit may provide a conductive path between at least two electrical components in a system. For example, the electrical components may be a system power source 102 and an electrical load 104 in the system. When the electrical relay device 100 closes the circuit, electrical current from the system power source 102 flows to the electrical load 104 to power the electrical load 104. The system power source 102 may be an AC power source or a DC power source such as one or more batteries, for example. The electrical load 104 may be one or more electronic components, such as within a computer, motors, or other system components.

The electrical relay device 100 may include or be coupled to a circuit board 105. Portions of the circuits between the power source 102 and the electrical load 104 are provided by the circuit board 105, such as along traces on the circuit board 105. The electrical relay device 100 includes a housing 106 mounted to a mounting surface 107 of the circuit board 105 and various components at least partially within the housing 106. In the illustrated embodiment, the system includes a first circuit 110 and a second circuit 112. The first circuit 110 electrically connects the power source 102 to a first electrical load 104 while the second circuit 112 electrically connects the power source 102 to a second electrical load 104. The system may include any number of circuits, including a single circuit. The electrical relay device 100 is used open and/or close the various circuits 110, 112.

The housing 106 extends between a closed end 120 and an open end 122. The housing 106 defines a chamber 124 that receives the various components of the relay device 100 therein. The open end 122 defines an opening 126 to the chamber 124, which may be the only access for loading components into the chamber 124. For example, the housing 106 may be a box-shaped vessel that is open at the open end 122 and closed at the closed end 120. The housing 106 may have a generally rectangular cross-section extending between the closed end 120 and the open end 122. In other embodiments, the housing 106 may have other shapes, such as a cylindrical shape extending between the closed end 120 and the open end 122. The closed end 120 of the housing 106 faces the circuit board 105 and is configured to be mounted to the mounting surface 107 of the circuit board 105.

A cover 128 is coupled to the housing 106 at the open end 122 to close the opening 126 to the chamber 124. The cover 128 may be at least partially received in the chamber 124. The cover 128 may be entirely received in the chamber 124 in some embodiments. In the illustrated embodiment, the cover 128 is a generally planar structure defining a plate received in and covering the opening 126. Alternatively, the cover 128 may be a lid-type structure fitting over the edge of the housing 106 at the open end 122.

Figure 2:
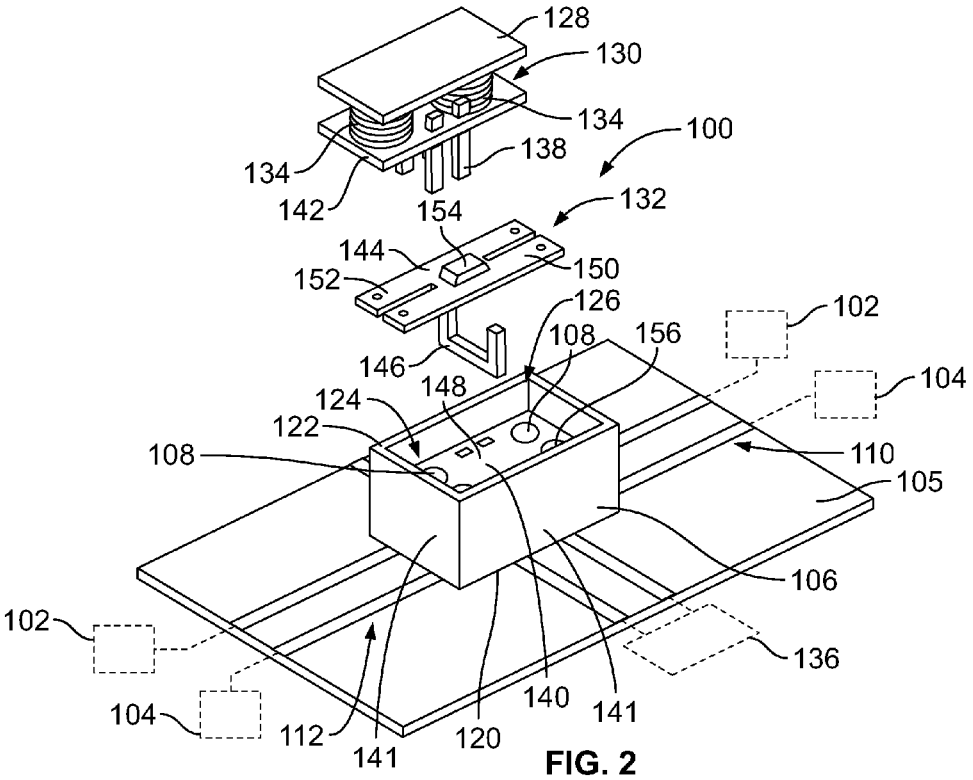
FIG. 2 is an exploded view of the electrical relay device formed in accordance with an exemplary embodiment.
Figure 3:
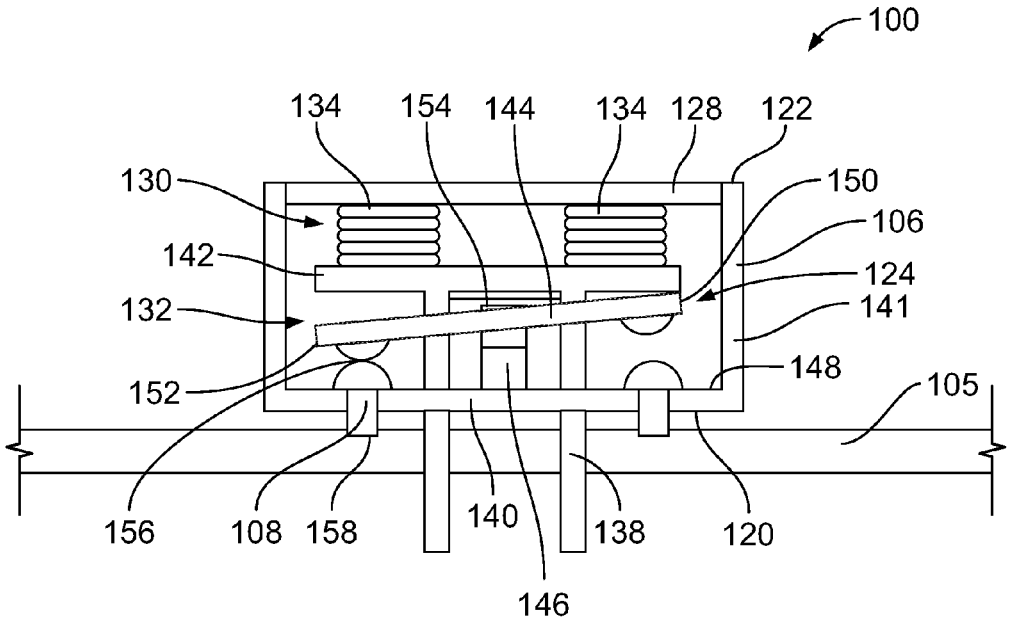
FIG. 3 is a cross sectional view of the electrical relay device in a first state.
Figure 4:
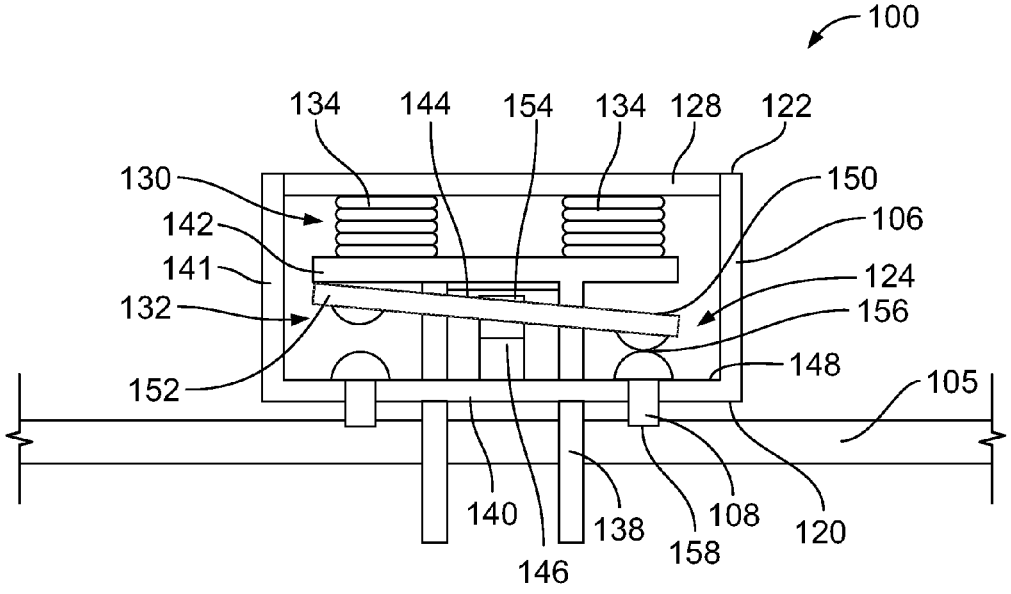
FIG. 4 is a cross sectional view of the electrical relay device in a second state.

FIG. 2 is an exploded view of the electrical relay device 100 formed in accordance with an exemplary embodiment. FIG. 3 is a cross sectional view of the electrical relay device 100 in a first state. FIG. 4 is a cross sectional view of the electrical relay device 100 in a second state. FIG. 2 shows various components of the electrical relay device 100 in accordance with an exemplary embodiment poised for loading into the housing 106. FIGS. 3 and 4 show the various components of the exemplary electrical relay device 100 in an assembled state with the housing 106 mounted to the circuit board 105.

The relay device 100 includes at least one stationary relay contact 108 held at least partially within the chamber 124 of the housing 106. In the illustrated embodiment, the relay device 100 includes four stationary relay contacts 108 arranged in pairs configured to be electrically connected to corresponding circuits of the circuit board 105. Each stationary relay contact 108 is configured to be electrically connected to an electrical component that is remote from the electrical relay device 100, such as the system power source 102 and the electrical load 104. The stationary relay contacts 108 may be spaced apart from one another to prohibit current from flowing directly between adjacent stationary relay contacts 108, such as by arcing.

The relay device 100 further includes a driver 130 for operating a switch member 132 of the relay device 100. The driver 130 and the switch member 132 are received in the chamber 124 of the housing 106. The driver 130 includes one or more coils 134 of wire configured to be electrically connected to a relay power source 136, which provides electrical energy to the coil 134 in order to induce a magnetic field. For example, the relay power source 136 may be electrically connected to the corresponding coil 134 via coil terminals 138 that provide a conductive current path. The coil terminals 138 may be pins or posts and may be configured to be directly mounted to the circuit board 105. For example, the coil terminals 138 may pass through an end wall 140 of the housing 106 at the closed end 120 to directly engage the circuit board 105. The end wall 140 defines a bottom of the chamber 124 and the sidewalls 141 may extend upward from the end wall 140 to the open end 122 to define the chamber 124. The coil terminals 138 may be soldered or press fit to the circuit board 105. The relay power source 136 is operated to selectively control the magnetic field induced by the current through the coil 134. The relay power source 136 may be selectively coupled to the different coils 134 to drive different magnetic fields, such as at different locations within the relay device 100 for operating the switch member 132. In the illustrated embodiment, first and second coil 134 are electrically separate and act to pivot the switch member 132 independently. In other embodiments, a single coil 134 may be provided or the two coils 134 may be arranged serially connected to form a single electromagnet that when energized, acts on the switch member 132 in one direction only. A return spring or permanent magnet to return the switch member 132 to the unenergized position may be provided in such embodiments.

In an embodiment, the coil 134 is spaced apart from the stationary relay contacts 108 within the housing 106. For example, the coil 134 in the illustrated embodiment is disposed proximate to the open end 122 of the housing 106 in an electromagnetic region of the chamber 124. The stationary relay contacts 108, on the other hand, are disposed proximate to the closed end 120 of the housing 106 within an electrical circuit region of the chamber 124. In an exemplary embodiment, the driver 130 includes a plate 142 spaced apart from the cover 128. The coil(s) 134 may be positioned between the cover 128 and the plate 142. The coil 134 may be coupled to the plate 142 and/or the cover 128 and may be loaded into the chamber 124 with the plate 142 and/or the cover 128. In various embodiments, the cover 128 may be separate from the driver 130 and coupled to the housing 106 after the components are assembled in the housing 106. Optionally, the coil(s) 134 may extend along coil axes that are oriented generally parallel to a loading direction of the components into the chamber 124. Other orientations are possible in alternative embodiments, such as parallel to the circuit board 105. The stationary relay contacts 108 are coupled to the end wall 140 of the housing 106 defining the closed end 120, such as at the bottom of the relay device 100. As used herein, relative or spatial terms such as "top," "bottom," "front," "rear," "left," and "right" are only used to distinguish the referenced elements and do not necessarily require particular positions or orientations in the electrical relay device 100 or in the surrounding environment of the electrical relay device 100.

The switch member 132 is provided within the chamber 124 of the housing 106, such as between the coil 134 and the end wall 140 at the closed end 120 of the housing 106. Providing the switch member 132 between the coil 134 and the end wall 140 provides a low profile relay device 100. For example, the components of the relay device 100 have a smaller component stack up height as compared to conventional relay devices provide the coil 134 between the switch member 132 and the end of the housing. By reducing the stack up height of the components, the housing 106 may be shorter to provide a low profile relay device 100. For example, the height from the circuit board 105 to the open end 122 in the cover 128 may be relatively small as compared to conventional relay devices.

The switch member 132 is configured to move between a first position (FIG. 3) and a second position (FIG. 4) based on a presence or absence of a magnetic field induced by current through the coil(s) 134. The switch member 132 may move by pivoting or rotating about a pivot axis. In an exemplary embodiment, the switch member 132 includes a movable relay contact 144. The movable relay contact 144 is pivotably coupled to the housing 106, such as to the end wall 140.

In an exemplary embodiment, the movable relay contact 144 is pivotable about a pivot yoke 146. The pivot yoke 146 may be positioned between the movable relay contact 144 and the end wall 140, such as along an interior 148 of the end wall 140. Optionally, the pivot yoke 146 may be coupled to the end wall 140 and/or to sidewalls 141. The pivot yoke 146 may be used to retain the movable relay contact 144 in position within the chamber 124 and may allow the movable relay contact 144 to pivot between the first and second positions. Optionally, the pivot yoke 146 may be manufactured from a steel material; however, the pivot yoke 146 may be manufactured from other materials in alternative embodiments.

The movable relay contact 144 may be manufactured from a conductive material, such as a copper or copper alloy; however, the movable relay contact 144 may be manufactured from other materials in alternative embodiments. In an exemplary embodiment, the movable relay contact 144 includes a first arm 150 and one and thereof and a second arm 152 at the opposite ends thereof. Optionally, the movable relay contact 144 includes an armature 154, such as extending from a top surface thereof approximately centered between the first and second arms 150, 152. The armature 154 and/or the first and second arms 150, 152 may be magnetically attracted to the magnetic field generated by the coil(s) 134 during operation of the driver 130.

As the switch member 132 is moved between the first and second positions, the first and second arms 150, 152 engage and are electrically connected to corresponding stationary relay contacts 108. Each stationary relay contact 108 is coupled to the end wall 140. For example, the stationary relay contacts 108 may be press-fit or inserted into corresponding channels in the end wall 140 and secured thereto. In other various embodiments, the housing 106 may be formed around the stationary relay contacts 108. For example, the housing 106 may be molded around the stationary relay contacts 108. In an exemplary embodiment, each stationary relay contact 108 includes a mating interface 156 exposed in the chamber 124 and a circuit board interface 158 exposed exterior of the housing 106, such as below the housing 106, for termination to the circuit board 105. The mating interface 156 may be a bump or protrusion extending partially into the chamber 124. Alternatively, the mating interface 156 may be flush with the interior of the end wall 140. In other various embodiments, the mating interface 156 may be recessed into the end wall 140. The circuit board interface may extend below the exterior of the housing 106 for interfacing with the circuit board 105. Alternatively, the circuit board interface 158 may be flush with the bottom of the housing 106 or may be recessed in the end wall 140. Optionally, solder may be provided at the circuit board interface 158 for soldering the stationary relay contacts 108 to the circuit board 105. The stationary relay contacts 108 may be terminated to the circuit board 105 by other means in alternative embodiments, such as by press fitting the stationary relay contacts 108 to the circuit board 105, such as using compliant pins.

The switch member 132 is moved by the presence and/or absence of a magnetic force generated by the coil(s) 134. In the illustrated embodiment, the relay device 100 includes first and second coils 134. When the relay power source 136 applies a current to the first coil 134, the current through the first coil 134 induces a magnetic field that acts on the switch member 132, causing the movable relay contact 144 to move to the first position (FIG. 3) with the first arm 150 lifted upward and attracted to the first coil 134. In the first position, the first arm 150 is moved away from and spaced apart from the corresponding stationary relay contacts 108 aligned below the distal end of the first arm 150. The second arm 152 is moved downward to engage the corresponding stationary relay contacts 108 aligned below the distal end of the second arm 152 and associated with the second circuit 112 (shown in FIG. 1). When the second arm 152 engages the stationary relay contacts 108, a closed circuit path is created between the pair of stationary relay contacts 108 through the movable relay contact 144 to close the second circuit 112 and thus allow power from the power source 102 to the second electrical load 104 (shown in FIG. 1). When the current from the relay power source 136 ceases, the first coil 134 no longer induces the magnetic field that acts upon the switch member 132, and the switch member 132 may return to a starting position (e.g., either the second position or a neutral position in which the movable relay contact 144 is generally aligned with the end wall 140, such as horizontally, with neither arm 150, 152 engaging any of the corresponding stationary relay contacts 108 such that both circuit paths are open). The switch member 132 may returns to the starting position due to forces such as gravity or spring forces. The switch member 132 may return to the starting position due to magnetic forces in the other coil 134.

When the switch member 132 is in the first position, the movable relay contact 144 engages the corresponding stationary relay contacts 108 associated with the second circuit 112 such that the movable relay contact 144 is conductively coupled to both stationary relay contacts 108. The movable relay contact 144, when in the closed circuit position, provides a closed circuit path between the two stationary relay contacts 108 associated with the second circuit 112. For example, electrical current is allowed to flow from one stationary relay contact 108 to the other stationary relay contact 108 across the movable relay contact 144, which bridges the distance between the stationary relay contacts 108. In the illustrated embodiment, when the switch member 132 is in the closed circuit position, electrical current from the system power source 102 is conveyed across the movable relay contact 144 to the second electrical load 104 to power the second electrical load 104. In response to the switch member 132 moving away from the closed circuit position towards the open circuit position (e.g., the neutral position or the second position), the movable relay contact 144 disengages the stationary relay contacts 108 associated with the second circuit 112, which breaks the second circuit 112 and ceases the flow of electrical current between the system power source 102 and the second electrical load 104. Although two stationary relay contacts 108 are shown in FIG. 2, it is recognized that the electrical relay device 100 in other embodiments may have a different number of stationary relay contacts 108 and/or a different arrangement of stationary relay contacts 108. For example, the movable relay contact 144 may be permanently electrically connected a first stationary relay contact and may be configured to move relative to a second stationary relay contact, engaging and disengaging only the second stationary relay contact, in order to close and open a circuit between the two stationary relay contacts.

When the relay power source 136 applies a current to the second coil 134, the current through the second coil 134 induces a magnetic field that acts on the switch member 132, causing the movable relay contact 144 to move to the second position (FIG. 4) with the second arm 152 lifted upward and attracted to the second coil 134. In the second position, the second arm 152 is moved away from and spaced apart from the corresponding stationary relay contacts 108 aligned below the distal end of the second arm 152. The first arm 150 is moved downward to engage the corresponding stationary relay contacts 108 aligned below the distal end of the first arm 150 and associated with the first circuit 110 (shown in FIG. 1). When the first arm 150 engages the stationary relay contacts 108, a closed circuit path is created between the pair of stationary relay contacts 108 through the movable relay contact 144 to close the first circuit 110 and thus allow power from the power source 102 to the first electrical load 104 (shown in FIG. 1). When the current from the relay power source 136 ceases, the second coil 134 no longer induces the magnetic field that acts upon the switch member 132, and the switch member 132 may return to a starting position (e.g., either the first position or a neutral position in which the movable relay contact 144 is generally aligned with the end wall 140, such as horizontally, with neither arm 150, 152 engaging any of the corresponding stationary relay contacts 108 such that both circuit paths are open). The switch member 132 may returns to the starting position due to forces such as gravity or spring forces. The switch member 132 may return to the starting position due to magnetic forces in the other coil 134.

When the switch member 132 is in the second position, the movable relay contact 144 engages the corresponding stationary relay contacts 108 associated with the first circuit 110 such that the movable relay contact 144 is conductively coupled to both stationary relay contacts 108. The movable relay contact 144, when in the closed circuit position, provides a closed circuit path between the two stationary relay contacts 108 associated with the first circuit 110. For example, electrical current is allowed to flow from one stationary relay contact 108 to the other stationary relay contact 108 across the movable relay contact 144, which bridges the distance between the stationary relay contacts 108. In the illustrated embodiment, when the switch member 132 is in the closed circuit position, electrical current from the system power source 102 is conveyed across the movable relay contact 144 to the first electrical load 104 to power the first electrical load 104. In response to the switch member 132 moving away from the closed circuit position towards the open circuit position (e.g., the neutral position or the first position), the movable relay contact 144 disengages the stationary relay contacts 108 associated with the first circuit 110, which breaks the first circuit 110 and ceases the flow of electrical current between the system power source 102 and the first electrical load 104. Although two stationary relay contacts 108 are shown in FIG. 2, it is recognized that the electrical relay device 100 in other embodiments may have a different number of stationary relay contacts 108 and/or a different arrangement of stationary relay contacts 108. For example, the movable relay contact 144 may be permanently electrically connected a first stationary relay contact and may be configured to move relative to a second stationary relay contact, engaging and disengaging only the second stationary relay contact, in order to close and open a circuit between the two stationary relay contacts.

The position of the switch member 132, and the movable relay contact 144 thereof, is controlled by the relay power source 136, which controls the supply of current to the coils 134 to induce the magnetic fields in the first or second coils 134. Optionally, one or the other coil 134 may be powered at a time causing the movable relay contact 144 to be in either the first or second positions. However, in some embodiments, neither coil 134 may be powered at certain times causing the movable relay contact 144 to be in the neutral position (e.g., not coupled to any of the stationary relay contacts 108, such as in a horizontal position), which is an open circuit position. The switch member 132 may be in the open circuit position in response to the relay power source 136 not supplying electrical current to the coils 134 or in response to the relay power source 136 supplying an electrical current to the coils 134 that has insufficient voltage to induce a magnetic field capable of moving the switch member 132 to one of the closed circuit positions. The switch member 132 may be moved to one of the closed circuit positions in response to the relay power source 136 providing an electrical current to one of the coils 134 that has sufficient voltage to induce a magnetic field that moves the switch member 132 to the closed circuit position. The relay power source 136 may provide between 2 volts (V) and 20 V of electrical energy to the coil 134 in order to move the switch member 132 from an open circuit position to a closed circuit position. In other various embodiments, the relay power source 136 may be a line voltage coil (e.g., 120 VAC or higher) that operates at a very low current level. In an embodiment, the relay power source 136 provides 14 V of electrical energy to move the switch member 132. By comparison, the system power source 102 may provide electrical energy through the electrical relay device 100 at higher voltages and higher current levels, such as at 140 V, 220 V, or the like. The electrical relay device 100 uses a low power signal to switch a higher power source. The flow of current from the relay power source 136 to the coil 134 is selectively controlled to operate the electrical relay device 100. For example, the relay power source 136 may be controlled by a human operator and/or may be controlled automatically by an automated controller (not shown) that includes one or more processors or other processing units.

Figure 5:
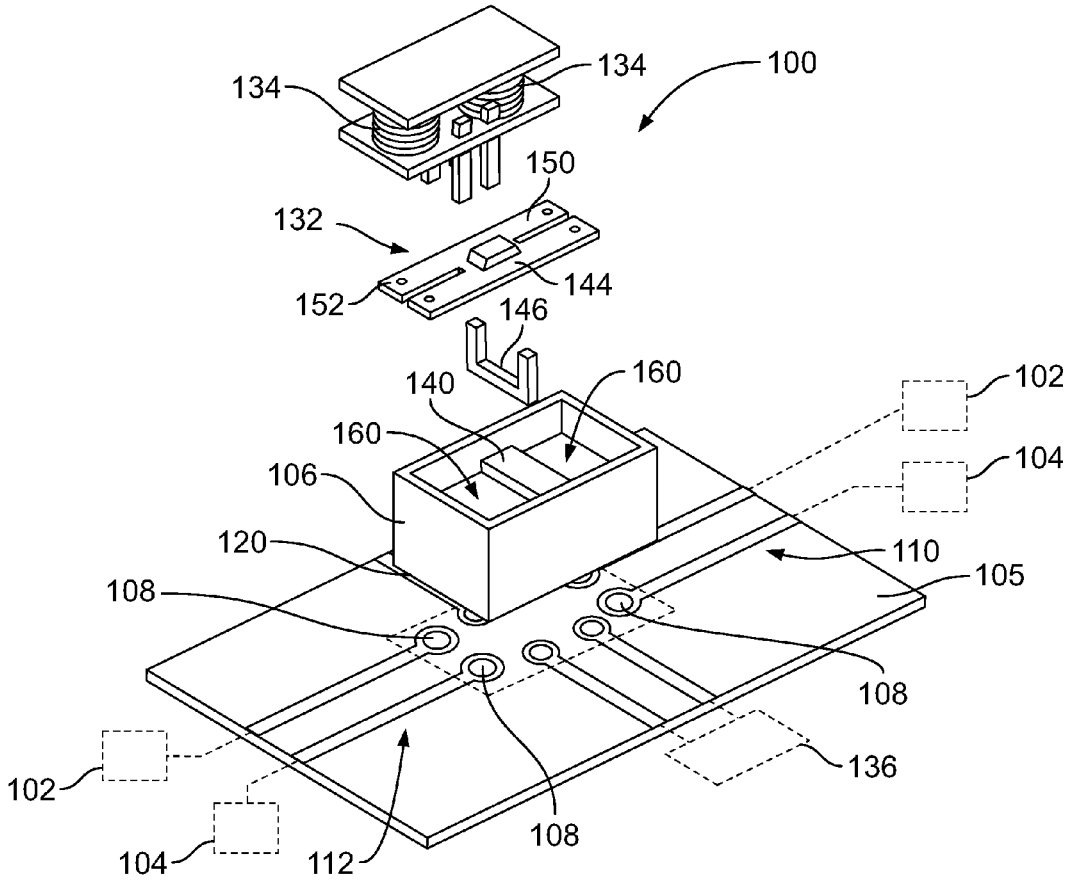
FIG. 5 is an exploded view of the electrical relay device formed in accordance with an exemplary embodiment.
Figure 6:
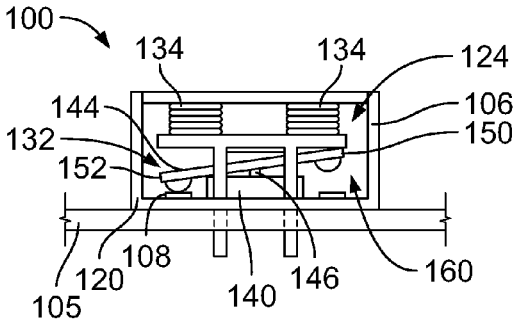
FIG. 6 is a cross sectional view of the electrical relay device shown in FIG. 5 in a first state.
Figure 7:
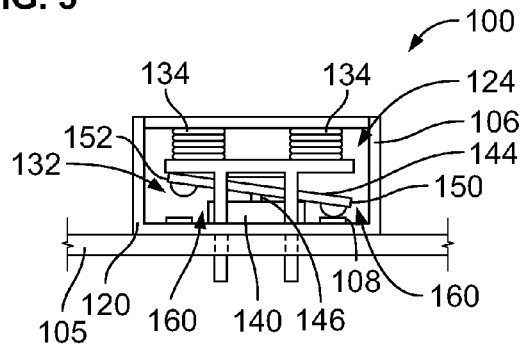
FIG. 7 is a cross sectional view of the electrical relay device shown in FIG. 5 in a second state.

FIG. 5 is an exploded view of the electrical relay device 100 formed in accordance with an exemplary embodiment. FIG. 6 is a cross sectional view of the electrical relay device 100 shown in FIG. 5 in a first state. FIG. 7 is a cross sectional view of the electrical relay device 100 shown in FIG. 5 in a second state. In an exemplary embodiment, the electrical relay device 100 includes openings 160 in the end wall 140.

The stationary relay contacts 108 are mounted directly to the circuit board 105, such as soldered to the circuit board 105, received in plated vias of the circuit board 105 or held by a thin carrier, such as a thin film to hold the relative positions of the contacts 108, which is mounted below the housing 106. In the illustrated embodiment, the relay device 100 includes four stationary relay contacts 108 arranged in pairs configured to be electrically connected to corresponding circuits of the circuit board 105.

The housing 106 is mounted to the circuit board 105 such that the stationary relay contacts 108 mounted on the circuit board 105 extend into the openings 160 for interfacing with the movable relay contact 144. The closed end 120 of the housing 106 is closed by the circuit board 105. Having the stationary relay contacts 108 mounted directly to the circuit board 105 may reduce the height or profile of the relay device 100. For example, the housing 106 may be narrower than the embodiment shown in FIG. 2. For example, the end wall 140 may be thinner or may be removed entirely. The stationary relay contacts 108 may be low profile contacts or may be integral circuits of the circuit board 105 to reduce the height of the stationary relay contacts 108 and thus reduce the overall height of the relay device 100.

The switch member 132 is provided within the chamber 124 of the housing 106 between the coil 134 and the closed end 120 with the movable relay contact 144 aligned with the openings 160. The first and second arms 150, 152 are aligned with corresponding openings 160. The pivot yoke 146 may be mounted to the end wall 140 between the openings 160. Alternatively, the pivot yoke 146 may be coupled to the side walls and span across the end 140 of the housing 106, such as when the opening 160 spans the entire end wall 140. The movable relay contact 144 is configured to move between a first position and a second position based on a presence or absence of a magnetic field induced by current through the coil(s) 134.

In the illustrated embodiment, the relay device 100 includes first and second coils 134. When the relay power source 136 applies a current to the first coil 134, the current through the first coil 134 induces a magnetic field that acts on the switch member 132, causing the movable relay contact 144 to move to the first position with the first arm 150 lifted upward and attracted to the first coil 134. In the illustrated embodiment, the first and second coil 134 are electrically separate and act to pivot the switch member 132 independently. In other embodiments, a single coil 134 may be provided or the two coils 134 may be arranged serially connected to form a single electromagnet that when energized, acts on the switch member 132 in one direction only. A return spring or permanent magnet to return the switch member 132 to the unenergized position may be provided in such embodiments. In the first position, the first arm 150 is moved away from and spaced apart from the corresponding stationary relay contacts 108 aligned below the distal end of the first arm 150. The second arm 152 is moved downward to engage the corresponding stationary relay contacts 108 aligned below the distal end of the second arm 152. The second arm 152 may be received in the opening 160 to engage the stationary relay contacts 108. For example, the end of the second arm 152 may be at least partially received in the end wall 140 and pass into the opening 160. Optionally, the second arm 152 may pass entirely through the end wall 140 and the opening 160 to interface with the stationary relay contacts 108 on the circuit board 105. When the second arm 152 engages the stationary relay contacts 108, a closed circuit path is created between the pair of stationary relay contacts 108 through the movable relay contact 144 to close the second circuit 112 and thus allow power from the power source 102 to the second electrical load 104. When the current from the relay power source 136 ceases, the first coil 134 no longer induces the magnetic field that acts upon the switch member 132, and the switch member 132 may return to a starting position (e.g., either the second position or a neutral position).

When the relay power source 136 applies a current to the second coil 134, the current through the second coil 134 induces a magnetic field that acts on the switch member 132, causing the movable relay contact 144 to move to the second position with the second arm 152 lifted upward and attracted to the second coil 134. In the second position, the second arm 152 is moved away from and spaced apart from the corresponding stationary relay contacts 108 aligned below the distal end of the second arm 152. The first arm 150 is moved downward to engage the corresponding stationary relay contacts 108 aligned below the distal end of the first arm 150. The first arm 150 may be received in the opening 160 to engage the stationary relay contacts 108. For example, the end of the first arm 150 may be at least partially received in the end wall 140 and pass into the opening 160. Optionally, the first arm 150 may pass entirely through the end wall 140 and the opening 160 to interface with the stationary relay contacts 108 on the circuit board 105. When the first arm 150 engages the stationary relay contacts 108, a closed circuit path is created between the pair of stationary relay contacts 108 through the movable relay contact 144 to close the first circuit 110 and thus allow power from the power source 102 to the first electrical load 104. When the current from the relay power source 136 ceases, the second coil 134 no longer induces the magnetic field that acts upon the switch member 132 and the switch member 132 may return to a starting position (e.g., either the first position or a neutral position).

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. An electrical relay device comprising:

a housing extending between a closed end and an open end, the housing defining a chamber, the closed end of the housing facing and being configured to be mounted to a circuit board;

a driver received in the chamber and being electrically connected to a relay power source, the driver having a plate, the driver having a coil and coil terminals configured to be terminated to the circuit board;

a switch member within the chamber of the housing that is configured to move between a first position and a second position based on a presence or absence of a magnetic field that is induced by current through the coil, the switch member including a movable relay contact that is spaced apart from at least one stationary relay contact when the switch member is in the first position and engages the at least one stationary relay contact to provide a closed circuit path when the switch member is in the second position; and a cover coupled to the housing at the open end, the cover retaining the coil and the movable relay contact positioned between the coil and the closed end of the housing in the housing and facing the circuit boards;

wherein the coil is positioned between the cover and the plate and the switch member is received between the plate and the closed end of the housing.

2. The electrical relay device of claim 1, wherein the cover is received in the chamber.

3. The electrical relay device of claim 1, wherein the housing includes an end wall at the closed end of the housing, the movable relay contact being pivotably coupled to the end wall.

4. The electrical relay device of claim 3, further comprising a pivot yoke extending from an interior of the end wall, the movable relay contact being pivotably coupled to the pivot yoke between the first and second positions.

5. The electrical relay device of claim 1, wherein the housing includes an end wall at the closed end, the stationary relay contacts being coupled to the end wall, each of the stationary relay contacts having a mating interface exposed in the chamber and a circuit board interface exposed exterior of the housing for termination to the circuit board.

6. The electrical relay device of claim 5, wherein the movable relay contact engages the stationary relay contact at the end wall when the switch member is in the second position.

7. The electrical relay device of claim 1, wherein the housing includes an end wall at the closed end, the end wall having openings therethrough, the housing being mounted to the circuit board such that the stationary relay contact mounted on the circuit board extends into the opening for interfacing with the movable relay contact.

8. The electrical relay device of claim 7, wherein the movable relay contact extends into the opening to engage the stationary relay contact when the switch member is in the second position.

9. The electrical relay device of claim 1, wherein the driver includes a second coil, the second coil driving the movable relay contact to the second position when a magnetic field is induced by current through the second coil.

10. The electrical relay device of claim 1, wherein the movable relay contact includes a first end and a second end, the second end engaging the stationary relay contact in the second position.

11. The electrical relay device of claim 10, wherein the first end engages at least one of the stationary relay contacts in the first position.

12. An electrical relay device comprising:

a housing extending between a closed end and an open end, the housing defining a chamber, the closed end of the housing facing and being configured to be mounted to a circuit board;

stationary relay contacts mounted to the closed end of the housing, each of the stationary relay contacts having a mating interface exposed in the chamber and a circuit board interface exposed exterior of the housing for termination to the circuit board;

a driver received in the chamber and being electrically connected to a relay power source, the driver having a coil and coil terminals configured to be terminated to the circuit board; and a switch member within the chamber of the housing that is configured to move between a first position and a second position based on a presence or absence of a magnetic field that is induced by current through the coil, the switch member including a movable relay contact that is spaced apart from at least one of the stationary relay contacts when the switch member is in the first position and engages at least one of the stationary relay contacts in the second position to provide a closed circuit path.

13. The electrical relay device of claim 12, wherein a cover is coupled to the housing at the open end, the cover holding the coil with the movable relay contact positioned between the coil and the closed end of the housing facing the circuit board.

14. The electrical relay device of claim 12, wherein the driver includes a plate, the coil being positioned between the cover and the plate, the switch member being received between the plate and the closed end of the housing.

15. The electrical relay device of claim 12, wherein the movable relay contact includes a first end and a second end, the second end engaging the stationary relay contact in the second position, the first end engages at least one of the stationary relay contacts in the first position.

16. An electrical relay device comprising:

a circuit board having a mounting surface and a power circuit at the mounting surface electrically connected to a relay power source;

stationary relay contacts mounted to the power circuit on the mounting surface of the circuit board, each of the stationary relay contacts having a mating interface;

a housing mounted to the circuit board at the mounting surface, the housing extending between a closed end and an open end, the housing defining a chamber, the housing having an end wall defining the closed end, the end wall having at least one opening therethrough, the closed end of the housing mounted to the mounting surface of the circuit board such that the stationary relay contacts are exposed to the chamber through the at least one opening in the end wall;

a driver received in the chamber and being electrically connected to the relay power source, the driver having a coil and coil terminals terminated to the circuit board; and a switch member within the chamber of the housing that is configured to move between a first position and a second position based on a presence or absence of a magnetic field that is induced by current through the coil, the switch member including a movable relay contact that is spaced apart from at least one of the stationary relay contacts when the switch member is in the first position and engages at least one of the stationary relay contacts in the second position to provide a closed circuit path.

17. The electrical relay device of claim 16, wherein a cover is coupled to the housing at the open end, the cover holding the coil with the movable relay contact positioned between the coil and the closed end of the housing facing the circuit board.

18. The electrical relay device of claim 16, wherein the movable relay contact extends into the opening to engage the stationary relay contact when the switch member is in the second position.

19. The electrical relay device of claim 16, wherein the movable relay contact includes a first end and a second end, the second end engaging the stationary relay contact in the second position, the first end engages at least one of the stationary relay contacts in the first position.

* * * * *